US009091073B2

(12) United States Patent
Wells

(10) Patent No.: US 9,091,073 B2
(45) Date of Patent: Jul. 28, 2015

(54) METHOD AND APPARATUS FOR TEMPORARY SURFACE PROTECTION

(71) Applicant: Brad Wells, Bloomfield Hills, MI (US)

(72) Inventor: Brad Wells, Bloomfield Hills, MI (US)

( * ) Notice: Subject to any disclaimer, the term of this patent is extended or adjusted under 35 U.S.C. 154(b) by 0 days.

(21) Appl. No.: 13/709,970

(22) Filed: Dec. 10, 2012

(65) Prior Publication Data

US 2014/0157712 A1 Jun. 12, 2014

(51) Int. Cl.
*E04F 13/075* (2006.01)
*E04F 15/02* (2006.01)
*E04G 21/30* (2006.01)

(52) U.S. Cl.
CPC ..... *E04F 15/02* (2013.01); *E04G 21/30* (2013.01)

(58) Field of Classification Search
CPC ..... E04F 13/075; E04G 21/30
USPC ..... 52/588.1, 796.1, 741.3, DIG. 9, DIG. 12
See application file for complete search history.

(56) References Cited

U.S. PATENT DOCUMENTS 3,262,723 A * 7/1966 Strickler ..... 403/265
3,385,743 A * 5/1968 Backberg ..... 428/191
3,506,532 A * 4/1970 Bock et al. ..... 428/31
3,597,302 A * 8/1971 Gerard ..... 428/126
3,692,340 A * 9/1972 Roth ..... 403/364
3,864,201 A * 2/1975 Susuki et al. ..... 428/106
3,895,981 A * 7/1975 Tesch ..... 156/71
4,025,686 A * 5/1977 Zion ..... 442/373
4,143,194 A * 3/1979 Wihksne ..... 428/81
4,172,918 A * 10/1979 Doerer ..... 428/174
4,263,347 A * 4/1981 Banta ..... 427/282
4,330,584 A * 5/1982 Doerer ..... 428/91
4,564,554 A * 1/1986 Mikuski ..... 428/292.4
4,584,225 A * 4/1986 Adelman ..... 428/71
4,784,887 A * 11/1988 Abendroth ..... 428/54
4,828,910 A * 5/1989 Haussling ..... 442/391
4,871,063 A * 10/1989 Kumbier ..... 206/386
5,011,007 A * 4/1991 Kenimer ..... 206/205
5,068,001 A * 11/1991 Haussling ..... 156/222
5,149,572 A * 9/1992 Gaggero et al. ..... 428/43
5,236,753 A * 8/1993 Gaggero et al. ..... 428/43
5,322,181 A * 6/1994 Nelson ..... 229/87.2
D353,505 S * 12/1994 Rea ..... D6/582
5,686,180 A * 11/1997 Rivlin et al. ..... 428/350
5,700,570 A * 12/1997 Fahmy ..... 428/342
6,029,419 A * 2/2000 Kimura ..... 52/796.1
6,048,605 A * 4/2000 Doyle ..... 428/214

(Continued)

FOREIGN PATENT DOCUMENTS

DE 3346528 A * 7/1984
EP 2644804 A2 * 10/2013

OTHER PUBLICATIONS

Product information for RAM Board Temporary Floor Protection, publicly available at least as early as Feb. 14, 2006 (4 pages).*

*Primary Examiner* — Rodney Mintz
(74) *Attorney, Agent, or Firm* — Howard B. Rockman

(57) ABSTRACT

A system for protecting floor and wall surfaces using at least one long fiber paper board made from 100% recycled materials. The flat paper board is entirely environmental friendly. The paper board has smooth top and bottom layers to protect the covered surfaces. The top and bottom layers are held together by an adhesive layer. The board uses no inks or dyes and the identifying marks are all embossed on the top or bottom layers of the board. The board in an embodiment has serrated edges and the board can be cut by a knife.

11 Claims, 5 Drawing Sheets

(56) References Cited

U.S. PATENT DOCUMENTS

| | | | | |
|---|---|---|---|---|
| 6,139,945 | A * | 10/2000 | Krejchi et al. | 428/317.9 |
| 6,148,577 | A * | 11/2000 | Smolenski et al. | 52/469 |
| 6,171,680 | B1 * | 1/2001 | Fahmy | 428/138 |
| 6,228,503 | B1 * | 5/2001 | Zickell | 428/489 |
| 6,815,022 | B2 * | 11/2004 | Renck et al. | 428/34.3 |
| 6,964,142 | B1 * | 11/2005 | Otani | 52/794.1 |
| 6,996,947 | B2 * | 2/2006 | Albora | 52/796.1 |
| 7,228,668 | B2 * | 6/2007 | Gibney et al. | 52/506.01 |
| 7,452,586 | B2 * | 11/2008 | Vershum | 428/137 |
| 7,493,736 | B2 * | 2/2009 | Sanders | 52/741.3 |
| 7,565,778 | B2 * | 7/2009 | Azeau | 52/741.3 |
| 7,569,266 | B2 * | 8/2009 | Howell | 428/218 |
| 7,818,941 | B2 * | 10/2010 | Freudenberg et al. | 52/741.3 |
| 8,048,507 | B2 * | 11/2011 | Townsend et al. | 428/100 |
| 8,052,037 | B2 * | 11/2011 | Bussey et al. | 229/87.02 |
| 8,389,107 | B2 * | 3/2013 | Riebel et al. | 428/211.1 |
| 2002/0062545 | A1 * | 5/2002 | Niedermair | 29/417 |
| 2003/0064194 | A1 * | 4/2003 | Lake et al. | 428/137 |
| 2003/0159373 | A1 * | 8/2003 | Lien | 52/202 |
| 2004/0040680 | A1 * | 3/2004 | Iwasaki | 162/135 |
| 2004/0131871 | A1 * | 7/2004 | Lee et al. | 428/481 |
| 2004/0261344 | A1 * | 12/2004 | Gibney | 52/506.01 |
| 2004/0261346 | A1 * | 12/2004 | Gibney et al. | 52/506.01 |
| 2006/0024475 | A1 * | 2/2006 | Vershum | 428/137 |
| 2006/0109602 | A1 * | 5/2006 | Vermillion | 361/212 |
| 2006/0210753 | A1 * | 9/2006 | Kadlec | 428/41.8 |
| 2008/0145580 | A1 * | 6/2008 | McAllister et al. | 428/36.4 |
| 2008/0160294 | A1 * | 7/2008 | Baig et al. | 428/332 |
| 2008/0250741 | A1 * | 10/2008 | Bennett et al. | 52/506.01 |
| 2008/0283719 | A1 * | 11/2008 | Lowry et al. | 248/615 |
| 2009/0178355 | A1 * | 7/2009 | Pugh et al. | 52/408 |
| 2009/0247382 | A1 * | 10/2009 | Bussey et al. | 493/464 |
| 2010/0015420 | A1 * | 1/2010 | Riebel et al. | 428/203 |
| 2011/0008586 | A1 * | 1/2011 | Lesniak | 428/188 |
| 2011/0189423 | A1 * | 8/2011 | Townsend et al. | 428/58 |
| 2011/0306255 | A1 * | 12/2011 | Rathenow | 442/1 |
| 2012/0090264 | A1 * | 4/2012 | Goss | 52/741.4 |
| 2013/0146205 | A1 * | 6/2013 | Blackwell et al. | 156/60 |
| 2013/0149511 | A1 * | 6/2013 | Riebel et al. | 428/211.1 |
| 2013/0333323 | A1 * | 12/2013 | Anderson et al. | 52/741.3 |
| 2014/0325934 | A1 * | 11/2014 | Eversley et al. | 52/741.3 |
| 2015/0056401 | A1 * | 2/2015 | Farah et al. | 428/78 |

* cited by examiner

METHOD AND APPARATUS FOR TEMPORARY SURFACE PROTECTION

BACKGROUND OF THE INVENTION

1. Field of the Invention

The present invention pertains generally to a temporary surface protection method and device. More specifically, the present invention provides a new temporary floor and wall protecting method and system for the temporary protection of a variety of sizes and types of floor, wall, and corner surfaces from dirt, liquids, chemical compounds or gouging caused by hard objects contacting, impacting or being dragged across the floor and wall surfaces.

2. Description of the Prior Art

The walking surface, also known as a floor, and the supporting surface, such as a wall, in a room, often need temporary protection from being damaged during a construction, repair or moving process. Many floor protection devices and methods are known in the prior art. More specifically, floor protection devices with adhesive or tacky surfaces are commonly used in places where it is desirable to prevent loose dirt, particles, debris and the like from being spread about. While the room is under construction, there is a need for temporary protection for the floors and walls of the room.

Workers, homeowners and apartment dwellers have been using laid-flat cardboard boxes to protect floors or walls for a long time. Other prior art floor protection devices include those disclosed in U.S. Pat. No. 6,148,577; U.S. Pat. No. 4,143,194; U.S. Pat. No. 5,011,007; and U.S. Pat. Des. No. 353,505. Floor protection products in the market include RAMBOARD® temporary floor protection products, which also provide temporary protection on a variety of floors. The RAMBOARD® covering is provided in a roll, but not flat. Products presently offered in the marketplace have only one single layer and are not capable of substantially absorbing impact force.

While the above mentioned devices fulfill their particular objectives and requirements, none of the prior art references disclose the present floor protection method and system.

SUMMARY OF THE INVENTION

The present invention provides a heavy-duty and reusable method and apparatus primarily developed for temporarily protecting a variety of sizes and types of floors or wall surfaces from contaminants and the destructive forces caused by hard objects.

The inventive system comprises use of a multi-layered laminated board made from 100% homogenous recycled paper, paperboard, and/or wood chip materials. The inventive system is very environmental friendly. The board comprises three layers: a top sheet, a bottom sheet, and between the two sheets there is a layer of filler bound by water based, biodegradable adhesives. The inventive floor and wall protection system in an embodiment uses no dyes or inks. Therefore, there can be no leaking of inks or dyes onto the floors, walls or other surfaces that the board is covering and protecting when in use. All logos and other product information on the board system are embossed as part of the manufacturing process.

The protection board of the present invention is made of long fiber recycled paper, paperboard, and/or wood chip materials, and is manufactured into flat sheets of a particularly designed thickness, usually around 80-90 mil thick. A layer of a poly plastic top layer could be added for water resistant purposes. When in use, the boards could be cut with a knife, thus avoiding the use of a saw to prevent damaging the underlying surfaces, therefore providing more protection for the covered surfaces. The protection board can be taped or otherwise mounted to a wall surface that requires protection. Unlike other rolled sheets currently in the market, because of the long fibers used in manufacturing, the present board protection system is made available in flat sheets of various sizes. Other available products on the market use short fibers of one size and dimension, and are only available in rolls but not flat sheets. The protection board sheets of an embodiment are available in the sizes of 4'×4', 4'×6', and 4'×8', or other sizes as required. Also, varieties of thickness of these sheets are available. The boards lay flat and are therefore stackable. The protection boards in an embodiment have serrated edges for interlocking themselves to each other, thus avoiding slippage. When installing the system onto the surfaces needing protection, serrated and straight edges can be taped together, and the tape never touches the surface that is protected by the board.

The protection board in the present invention can also provide temporary stair protection. In this embodiment, the protection board in the present invention is made or cut into pieces designed to fit stair treads and risers. The riser/tread board of the stair protection board is made from the same kind of material as the temporary floor protection boards. The riser/tread board is then adhesively attached to its counterpart and the stair bullnose guard temporarily.

The stair protection bullnose guard is made of recycled laminated materials with a paper hinge integrated into the guard. The paper hinge enables the guard to bend over the stair bullnose so the guard can be adhesively attached to the tread/rise protection boards.

The corner/edge protection board embodiment of the present invention is made in a similar manner and uses similar recycled materials as the floor/wall protection board and is manufactured in a substantially similar way. The corner/edge protection board is also made from recycled paperboard and water based adhesives. The corner/edge protection board of an embodiment is available in a 3" width on each lateral side dimension and 40" in height, or other sizes to fit the user's needs. With the sizes hereby provided, it should be understood that the implementation of other variations and modifications of the invention and its various aspects will be apparent to one skilled in the art, and that the invention is not limited by the specific embodiments or dimensions described.

Using the present system can provide heavy-duty temporary protection for the covered surfaces. The present system is made of 100% recycled paper, paperboard, wood chips, or other materials, and is also smooth to protect the surface of the wall, floor, corner, or edge of a room. The boards used in the system are all Forest Stewardship Council (FSC) and Made In USA certified. The corner guards are 100% Recycled Paperboard Alliance (RPA) certified.

DETAILED DESCRIPTION OF THE ILLUSTRATED EMBODIMENTS

Figure 1:
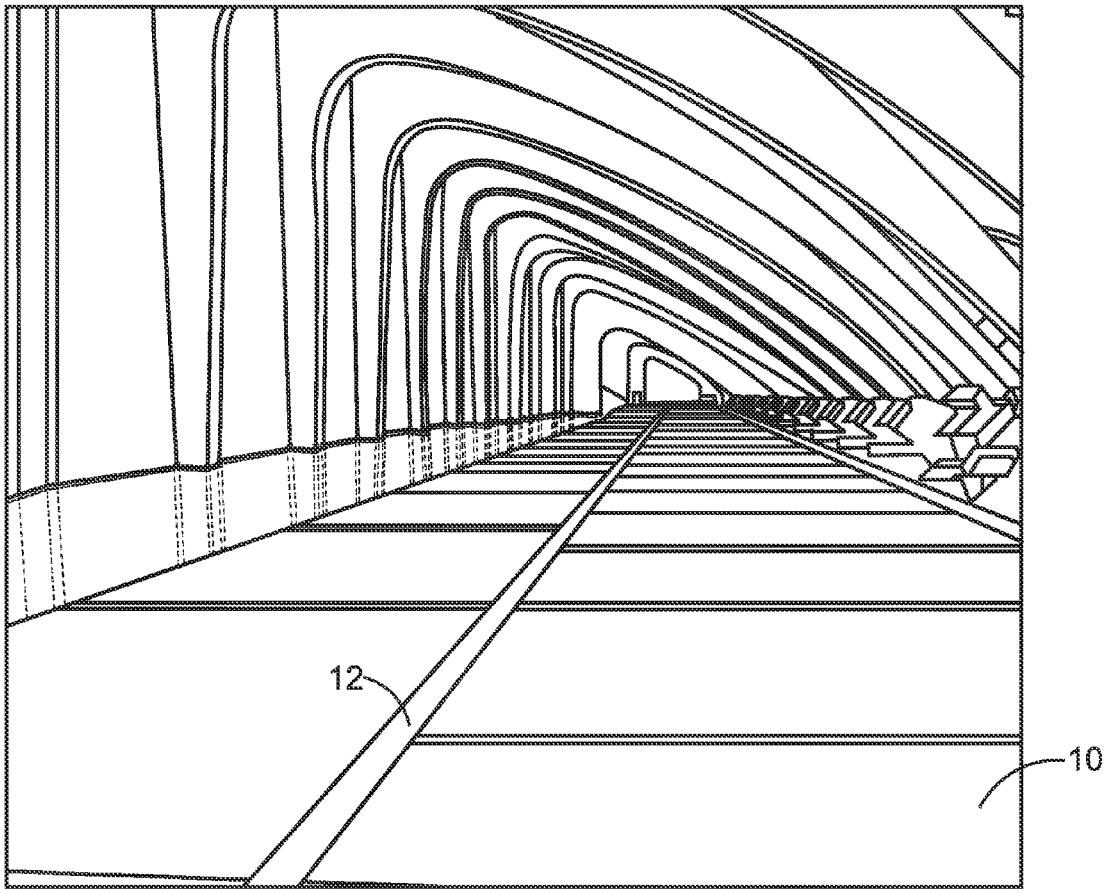
FIG. 1 is a layout view showing the protection boards of an embodiment of the present invention covering a floor during an equipment move-in project.
Figure 2:
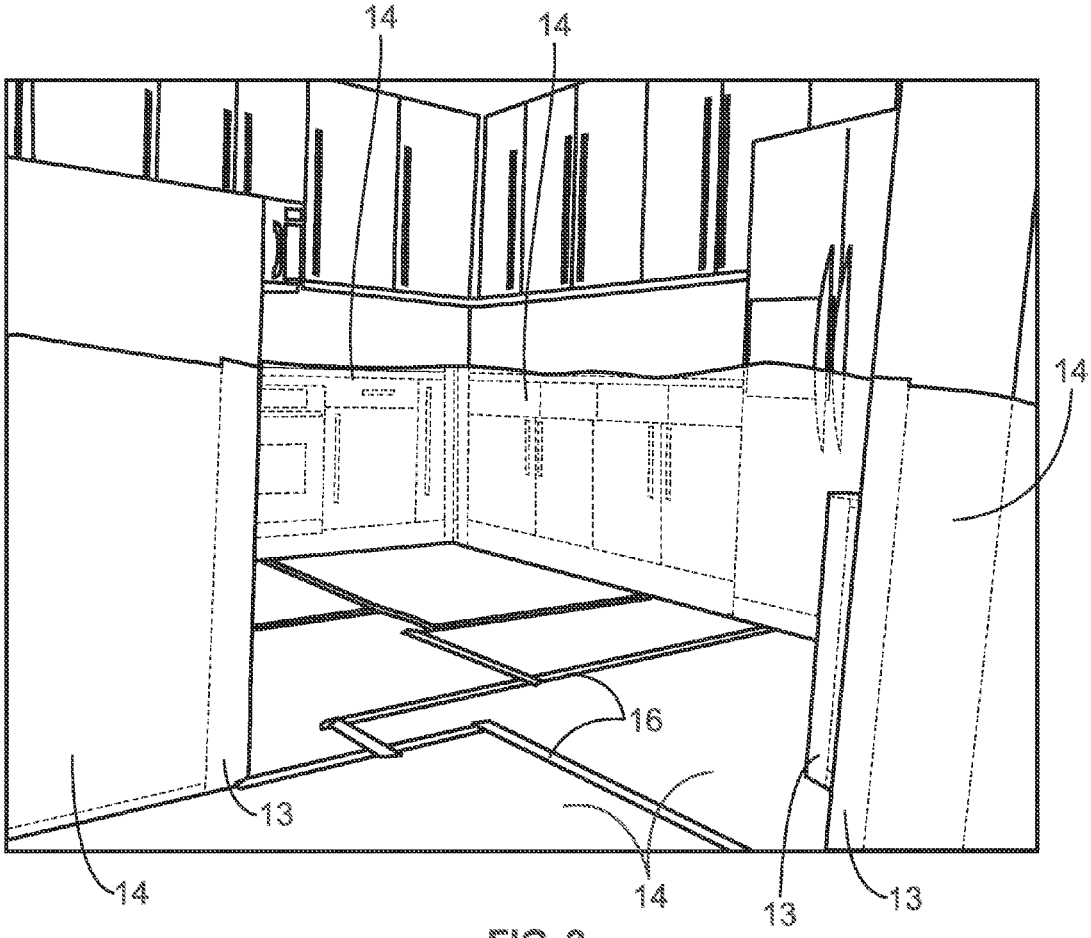
FIG. 2 is a layout view showing the temporary protection boards covering the floor of a kitchen and corner guards covering cabinet corners.

Referring to FIGS. 1 and 2, FIG. 1 shows several pieces of the protection boards 10 of the present invention covering the floor in a hallway. The protection boards 10 are closely connected to each other by stripes of tape 12 to cover the floor. The stripes of tape 12 hold the protection boards 10 together to prevent the boards from moving away from their intended positions, which prevents exposure of the floor surface to the workers or materials on the upper surface of the protection boards.

FIG. 2 also shows several pieces of the protection boards 14 covering the floor of a kitchen. The protection boards 14 shown in this illustration were cut into different shapes to combine with each other to fully cover the kitchen floor. The boards 14 can be cut with a knife and thus avoid the use of a saw, offering greater protection for the underlying surface. The protection boards are also held together by stripes of tape 16. The protection boards 14 are thus connected to each other in their intended position and fully cover the floor. As seen in FIG. 2, the boards 14 can be cut and configured to fit over any shaped floor surface.

Corner protection sheet 13 is also shown in FIG. 2. The "L" shaped corner protection sheet 13 is adhesively attached to the corner of the cabinets, where the "L" fits into the corner that has 90 degree angle, and connects surfaces of different dimensions. The corner protection sheet 13 illustrated in FIG. 2 is taller than the height of the cabinets to give the cabinets full protection. The corner protection sheet 13 will be further explained in the detailed description of FIG. 5.

Figure 3:
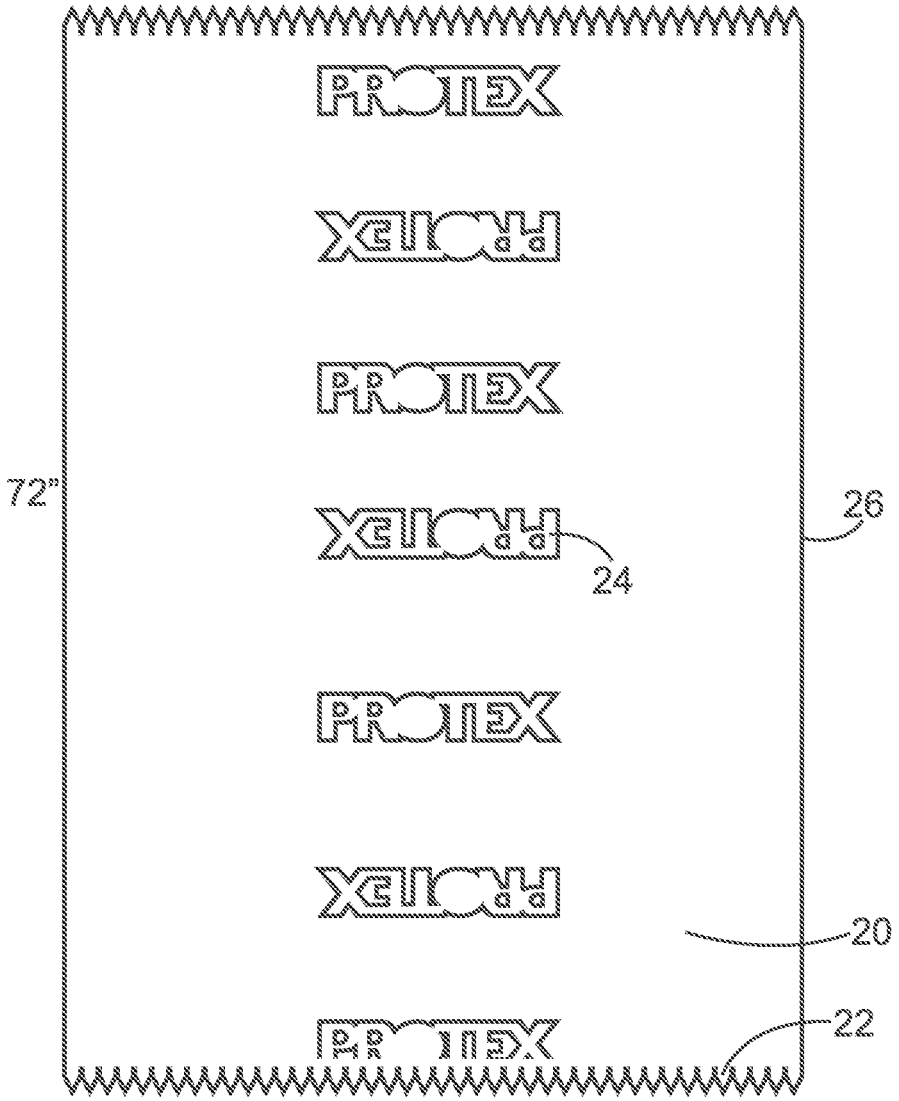
FIG. 3 is a layout view showing another embodiment of the protection board with an embossed surface and serrated edges.

FIG. 3 shows a top layout view of one flat protection board 20. The board 20 shown in FIG. 3 is 72"×48", but can also be of different sizes. The board 20 has serrated edges 22 on the outside edges, and also has the PROTEX logo 24 embossed onto the surface of the board 20. The other two edges 26 of the protection board 20 are smooth. The serrated edges can be taped together to join several boards 20 together, and the tape never touches the surface that is protected by the board. Because there are no inks or dyes used in manufacturing the protection board 20, there will be no leach of inks or dyes or damage to the surfaces covered by the boards 20.

In the present embodiment shown in FIG. 3, the serrations 22 of the board 20 are relatively small, like a knife edge. Other sizes of serrations may be used as the user so requires.

Figure 4:
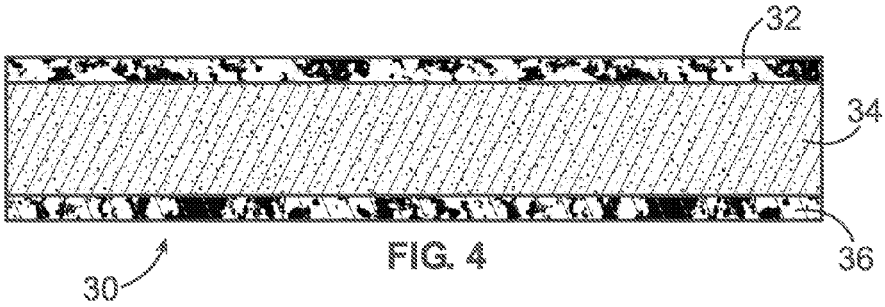
FIG. 4 is a schematic cross-section view of the protection board of FIGS. 1-3.

FIG. 4 shows a schematic cross section view of the protection board 30 of the present invention. The board 30 is usually around 80-90 mil thick. The board 30 comprises three layers: a top sheet 32, a bottom sheet 36, and a thicker middle filler layer made of homogenous recycled materials bound together via water based, biodegradable adhesives 34 between top sheet 32 and bottom sheet 36. The top sheet 32 and the bottom sheet 36 are made from 100% recycled long fiber paper, paperboard, or wood chips materials, with the recycled paper and/or paperboard long fibers and the biodegradable adhesive, the board of the present invention is entirely environmental friendly.

In one embodiment, the protective board (FIG. 4) of the present invention can be manufactured on a machine with a forty-eight inch width capacity that forms the top and bottom board layers 32, 36. The layers 32 and 36 comprise recycled paper materials or wood chips. The pulp of recycled paper materials or wood chips are pressed so that the liquid is squeezed out from the chips and the chips are dried in their flat configuration. The wood chip fibers in each sheet are then held by adhesive to form the flat protection board. The adhesive layer 34 is applied between layers 32, 36 while the filling adhesive material is a liquid. The board and adhesive structure are then dried together, and the embossed product identification or logo 24 (FIG. 3) is then applied before the combined board structure 30 leaves the machine. The board structure 30 then passes between pressure rollers that squeeze the water out of the structure. No acids, bleaches, dyes, inks, or harmful chemicals are used in the manufacture of board 30 (FIG. 4), and no such materials are found in the finished product, making the final product safe for children to walk on when construction or other activities on top of the boards have ceased. The final protection board product is PH neutral with no acidity. The final protection board product also provides better impact absorption than other single layer products. Another embodiment of this protection board has a white recyclable poly layer on top of the top layer 32 for water resistance purposes and increases puncture resistance.

Figure 5:
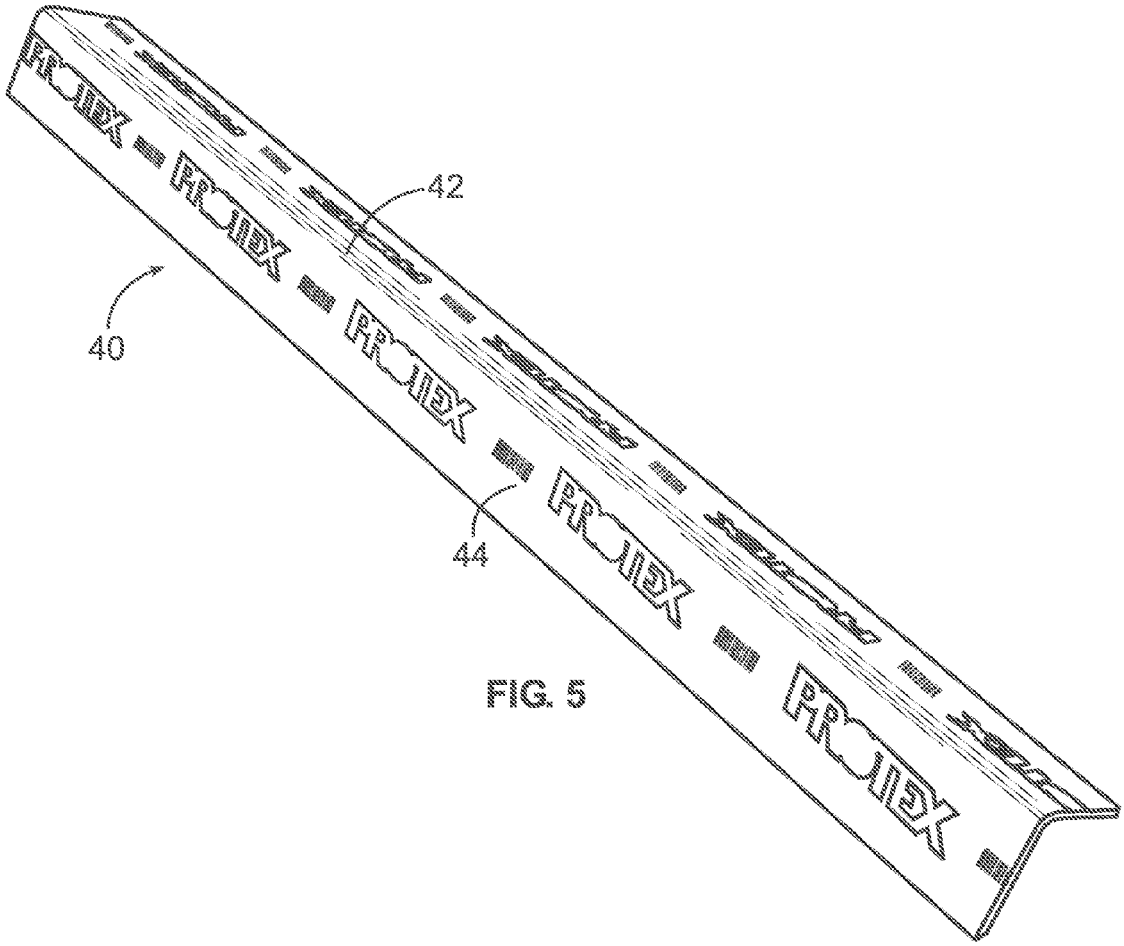
FIG. 5 is a layout view showing an embodiment of the corner protection board of the present invention.

FIG. 5 shows an embodiment of the corner/edge protection sheet 40. The protection sheet is also made of recycled paperboard. The top and bottom layer of the corner protection sheet are covered with smooth paper made from recycled materials. The smooth paper is applied to fully and seamlessly cover the top layer 44 and a substantial portion of the bottom layer, i.e. 80%, due to the machine limitations. The smooth paper prevents marks or marring to the protected surfaces.

The corner protection sheet of FIG. 5 is made from a mix of long and short fibers. The top and bottom layers of the corner protection sheet are held by an adhesive layer comprising thick, strong, and water based adhesive. The corner protection sheet is in the range of 120-160 mil thick. All logos are printed on the outer cover of the protection sheet, using water based or biodegradable inks. These inks do not come into contact with the corner wall surfaces. The corner protection sheet is then bent to ninety degrees at the bend line 42 into an "L" shape. There can also be a paper hinge integrated into the corner protection board to cover the corner or edge that needs protection.

Figure 6:
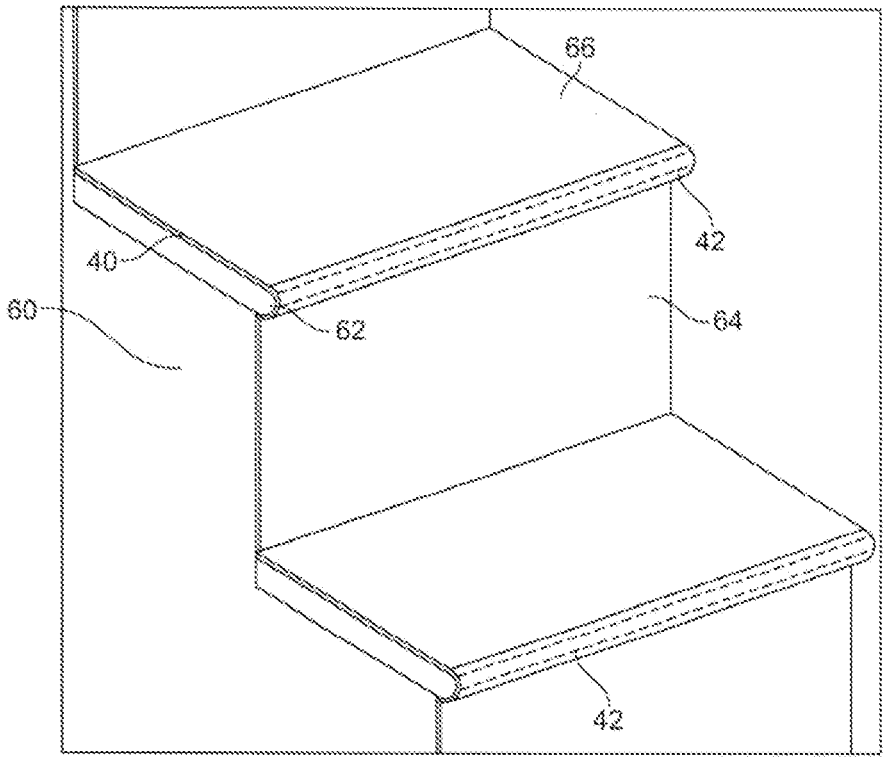
FIG. 6 is an illustration of the "L" shaped corner protection sheet protecting the stairs.

The "L" shaped corner protection sheet can also be made into various sizes to protect the stairs 60 as illustrated in FIG. 6. In this embodiment, a paper hinge is integrated into the stair protection board at the bend line 42. The paper hinge can bend over the stair bullnose 62 to provide the curvature to completely cover the stair bullnose 62 part of the stairs. The vertical piece riser 64 and the horizontal piece tread 66 of the stair protection boards 40 are made from the same material as the temporary floor protection board sheets described previously. Materials used to make the corner protection sheet include recycled kraft paper and paperboard. The riser 64 and tread 66 of the stair protection boards 40 are sized to fit the stair or raiser dimensions. All materials used in the stair protection boards are homogenous and 100% recyclable.

The present invention has been described as a temporary surface covering for floors, corners, edges or stairs. However, it is also contemplated that one or more of the protection boards disclosed and described herein may also be used to cover vertically extending wall surfaces, or surfaces other than floors that require protection. In such uses, the rear surfaces of the boards are taped or otherwise adhered to the vertical or other surface, using for example, two-sided tape, a pealable adhesive, or another adhering system as is known in the art.

Compared to other floor and surface covering material presently available, the protection boards of the present invention have an improved impact absorption quality. The boards of the present invention have a density similar to that of presently available materials, but are about twice as thick. Thus, the impact force on the board of the present invention is more efficiently distributed over the area of the board.

In addition, compared to presently available surface protective covering materials, the presently disclosed boards are manufactured flat and dried into flat sheets of various dimensions, not in rolls. The boards of the present invention are manufactured as used in a flat configuration in sizes that can be placed directly over a surface to be protected.

A specific embodiment of a surface protection board has been described for the purpose of illustrating the manner in which the invention is made and used. It should be understood that the implementation of other variations and modifications of the invention and its various aspects will be apparent to one skilled in the art, and that the invention is not limited by the specific embodiments described. Therefore, it is contemplated to cover the present invention and any and all modifications, variations, or equivalents that fall within the true spirit and scope of the basic underlying principles disclosed and claimed herein.

What is claimed:

1. A system for temporarily protecting interior permanently installed building floor or wall surfaces, comprising:

at least a top layer and a bottom layer formed into a flat sheet, said top and bottom layers comprising long fibers;

said long fibers comprised of homogeneous recycled material;

said top and bottom layers adhered together by an adhesive layer, said adhesive layer including homogeneous recycled material generated fibers bound together by a water based, biodegradable adhesive;

said adhesive layer covering substantially one surface of the top layer, and one surface of the bottom layer;

said long fibers in the bottom and top layers are adhered together with the water based, biodegradable adhesive, said long fibers preventing said flat sheet from bending when installed for temporary wall or floor protection;

said flat sheet having at least one serrated edge and smooth top and bottom surfaces; and said flat sheet adapted to be removably placed over said wall and floor surfaces for temporary protection.

2. The system for temporarily protecting interior permanently installed building floor or wall surfaces as set forth in claim 1, wherein said at least one serrated edge comprises two serrated outside edges.

3. The system for temporarily protecting interior permanently installed building floor or wall surfaces as set forth in claim 1, wherein said top, bottom and adhesive layers are dried together in the top, bottom and adhesive layers' flat configuration during the manufacture of the flat sheet.

4. The system for temporarily protecting interior permanently installed building floor or wall surfaces as set forth in claim 1, wherein said at least one serrated edge interlocks with serrated edges on other flat sheets, and install the system into place.

5. The system for temporarily protecting interior permanently installed building floor or wall surfaces as set forth in claim 1, wherein at least two said flat sheets are taped together when in use.

6. The system for temporarily protecting interior permanently installed building floor or wall surfaces as set forth in claim 1, wherein said flat sheet lies flat and is stackable.

7. The system of claim 1, wherein the flat sheet is free of dyes and inks.

8. The system of claim 1, wherein a thickness of said flat sheet is in the range of 80-90 mil.

9. The system of claim 1, wherein a layer of smooth flat paper extends over said top layer and over a substantial portion of said bottom layer.

10. The system for temporarily protecting interior permanently installed building floor or wall surfaces as set forth in claim 1, wherein said flat sheet is formed in an "L" shape and is adapted for corner and edge protection.

11. The system of claim 10, wherein a thickness of said "L" shaped sheet is in the range of 120-160 mil.

* * * * *